US005285048A

United States Patent [19]

Nakase

[11] Patent Number: 5,285,048

[45] Date of Patent: Feb. 8, 1994

[54] AUTOMOBILE WINDSHIELD ANTENNA INCORPORATING WINDSHIELD HEATER

[75] Inventor: Kazuhiko Nakase, Tokyo, Japan

[73] Assignee: Harada Kogyo Kabushiki Kaisha, Tokyo, Japan

[21] Appl. No.: 831,183

[22] Filed: Feb. 5, 1992

[30] Foreign Application Priority Data

Feb. 5, 1991 [JP] Japan ..... 3-035436

[51] Int. Cl.[5] ..... H01Q 1/32; H01Q 1/02

[52] U.S. Cl. ..... 219/203; 343/704; 343/711; 343/713

[58] Field of Search ..... 219/203, 522; 343/704, 343/711, 712, 713, 729

[56] References Cited

U.S. PATENT DOCUMENTS

| | | | |
|---|---|---|---|
| 3,771,159 | 11/1973 | Kawaguchi et al. | 343/713 |
| 4,063,247 | 12/1977 | Sakurai et al. | 219/203 |
| 4,439,771 | 3/1984 | Kume et al. | 219/203 |
| 4,491,844 | 1/1985 | Tsuchie et al. | 343/713 |
| 4,791,426 | 12/1986 | Lindenmeier et al. | 343/713 |
| 4,849,766 | 7/1989 | Inaba et al. | 343/713 |
| 4,954,797 | 9/1990 | Shinnai et al. | 219/203 |
| 5,083,133 | 1/1992 | Takayama | 343/704 |
| 5,083,134 | 1/1992 | Saitou et al. | 343/713 |
| 5,097,270 | 3/1992 | Lindenmeier et al. | 343/704 |
| 5,119,106 | 6/1992 | Murakami | 343/713 |

*Primary Examiner*—Bruce A. Reynolds
*Assistant Examiner*—John A. Jeffery
*Attorney, Agent, or Firm*—Koda and Androlia

[57] ABSTRACT

An automobile antenna including a defogging heater wire and a conductor combined into a simple structure to accomplish a good FM reception. A capacitor which effects high-frequency grounding of the terminals of a defogging heater wire is installed between the terminals and a vehicle body; alternately, FM choke coils can be installed which prevents the heater wire from receiving high-frequency signals from a power source of the heater wire. The heater wire which resonates in the FM frequency band but not in the AM frequency band is inductively and capacitively coupled to the conductor which is installed on the surface of the window glass and resonates in the FM frequency band but not in the AM frequency band. The heater wire and conductor are installed in such a positional relationship that a double resonance is created.

7 Claims, 6 Drawing Sheets

AUTOMOBILE WINDSHIELD ANTENNA INCORPORATING WINDSHIELD HEATER

DETAILED DESCRIPTION OF THE INVENTION

1. Field of Industrial Utilization

The present invention relates to a glass antenna for automobiles which uses, as a part of the antenna, a defogging heater wire installed in the rear windshield and more particularly to an antenna which is a combination of the heater wire and a separately mounted antenna to receive FM and AM broadcasts, etc.

2. Prior Art

The antennas shown in FIGS. 8 and 9 are known as examples of conventional automobile glass antennas.

In the antenna shown in FIG. 8, a main antenna A which has an antenna output terminal is formed on the surface of window glass 10 as a separate element from a defogging heater wire H. Generally, main antennas are formed in an asymmetrical shape so that they are resonant in the FM frequency band at the most optimized reception and maintain the improved FM directionality. However, even if such a structure is taken, matching cannot be accomplished for the entire FM reception frequency band because the area which can be used as an antenna is small. As a result, the FM reception sensitivity is low, and the FM directionality is not sufficiently good. In addition, AM reception sensitivity is also low. As a result, in order to improve the FM and AM reception sensitivities, an FM compensating amplifier 31 and an AM compensating amplifier 32 are used between the antenna output terminal and a feeder cable F.

In the conventional antenna illustrated in FIG. 9, an AM choke coil CHa and an FM choke coil CHfO are utilized. These coils are for blocking high-frequency signals at both terminals of the defogging heater wire H; as a result, the heater wire H thus "insulated in terms of high-frequency" from power supply circuit B can be used as an antenna. As seen from the above, since the heater wire H is used as an antenna though it is originally not designed to be an antenna, matching cannot be obtained in the FM frequency band, and the FM reception sensitivity is low. On the other hand, since there is a large amount of stray capacitance for the AM frequency band, the capacitance splitting loss increases, which brings an AM reception sensitivity drop. As a result, in order to compensate for the poor FM and AM reception sensitivities, the FM compensating amplifier 31 and the AM compensating amplifier 32 are installed between the antenna output terminals and the feeder F.

PROBLEMS WHICH THE PRESENT INVENTION ATTEMPTS TO SOLVE

In the above-described conventional antennas, a matching for the entire FM reception frequency band cannot be obtained if only the main antenna A or heater wire H is used, and as a result, the FM reception sensitivity drops. That is why the FM compensating amplifier 31 is used in the conventional antennas. When the FM compensating amplifier 31 is used, it is necessary that the amplifier 31 is a broad-band amplifier which can cover the entire FM reception frequency band. This, however, brings about noise and cross-modulation or inter-modulation in intense electric fields.

The object of the present invention is to provide a glass antenna for automobiles which has a good FM reception with a simple structure of a combination of a heater wire and a conductor.

MEANS TO SOLVE THE PROBLEMS

In the present invention, a capacitor or FM choke coils are utilized. The capacitor which in terms of high-frequency grounds heater wire terminals is installed between the heater wire terminals and a vehicle body. On the other hand, the FM choke coils are one which in terms of high-frequency insulate the defogging heater wire from a power supply circuit. The defogging heater wire, which resonates in the FM frequency band but not in the AM frequency band, is inductively and capacitively coupled with a conductor, which is installed on the surface of window glass and resonates in the FM frequency band but not in the AM frequency band, and the defogging heater wire and conductor are installed in such a positional relationship that they create a state of double resonance.

EMBODIMENTS

Figure 1:
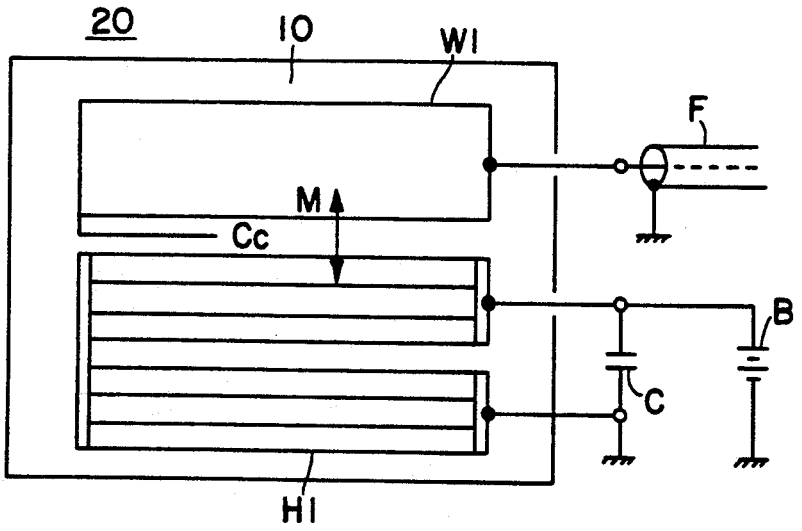
FIG. 1 illustrates one embodiment of the present invention.

FIG. 1 is a block diagram representing one embodiment of the present invention.

This embodiment is for an automobile glass antenna which receives FM and AM reception frequency bands and is composed of a heater wire H1, a wire (conductor) W1 and a capacitor C.

The heater wire H1 is one used to remove window glass fog (called "defogging heater wire"). The defogging heater wire H1 resonates in the FM reception frequency band but not in the AM reception frequency band. On the other hand, the wire W1 resonates in the FM reception frequency band but not in the AM reception frequency band and is installed in a window glass 10. The wire W1 has an output terminal, and a feeder F is connected to the output terminal of this wire W1.

The capacitor C effects high-frequency grounding of the terminals of the heater wire H1. The capacitance of this capacitor C is 500 pF or greater, preferably 1000 to 5000 pF. The heater wire H1 has a folded-back shape, and one end of the terminal of the wire H1 is grounded directly to the automobile body 20 and another end is grounded in terms of high-frequency via the capacitor C. Thus, the heater wire H1 forms an antenna with one end (the right end in FIG. 1) grounded and another end (the left end in FIG. 1) open.

For the FM reception frequency, the heater wire H1 and wire W1 are inductively and capacitively coupled. The heater wire H1 and wire W1 are installed in a positional relationship such that the coupling strength of the two is more or less in a critical coupling value, thus forming a state of double resonance. The inductive coupling strength can vary depending upon the distance and mutual positional relationship between the heater wire H1 and wire W1, and the capacitive coupling strength can vary depending upon the magnitude of the coupling capacitance Cc formed by the heater wire H1 and a part of the wire W1 and also upon the positional relationship between the heater wire and the wire.

When the coupling strength becomes greater than a critical coupling value, the frequency band characteristics (reflection loss characteristics) can change from single-peak characteristics to double-peak characteristics. The optimal coupling between the two is obtained by changing, with a use of a network analyzer, the positional relationship and coupling capacitance of the heater wire H1 and wire W1 until a desired frequency band range is obtained and until a dimensional, positional relationship and coupling capacitance which produce the minimum reflection loss are obtained.

For the AM reception frequency band, only the wire W1 acts as an antenna. Accordingly, the shape and position of the wire W1 are determined so that a stray capacitance of the wire W1 can be minimal. More specifically, an antenna with a small stray capacitance can be obtained if the wire W1 is provided approximately 3 cm or higher above the automobile body 20 and the heater wire H1.

Next, the operation of the above-described embodiment will be described. A description begins with an inductive coupling between the wire W1 and heater wire H1.

An FM reception in the inductive coupling will be described first.

FIG. 2 shows a principle of operation and an equivalent circuit for the FM reception frequency band when the wire W1 and heater wire H1 are inductively coupled in the above embodiment. FIG. 3 shows a principle of operation and an equivalent circuit for the FM reception frequency band when the wire W1 and heater wire H1 are capacitively coupled in the embodiment.

Figure 2A:
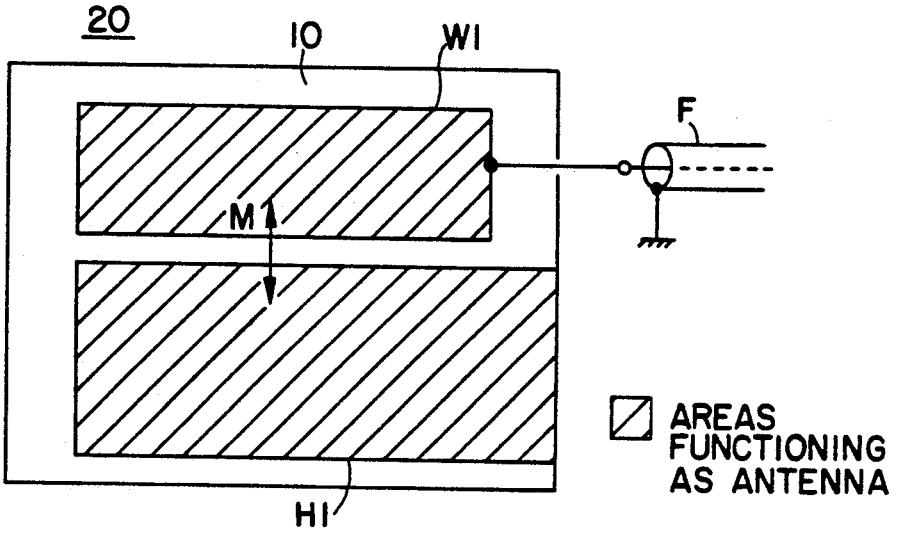
FIGS. 2*a* and 2*b* show the principle of operation of inductive coupling for an FM reception frequency band and an equivalent circuit therefor in the embodiment above.
Figure 3A:
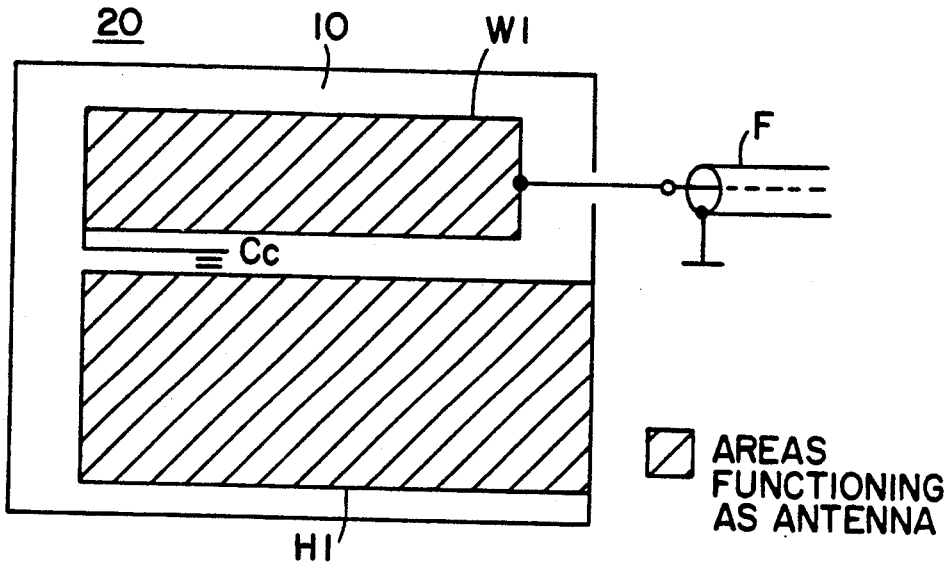
FIGS. 3*a* and 3*b* show the principle of operation of capacitive coupling for an FM reception frequency band and an equivalent circuit therefor in the embodiment above.
Figure 3B:
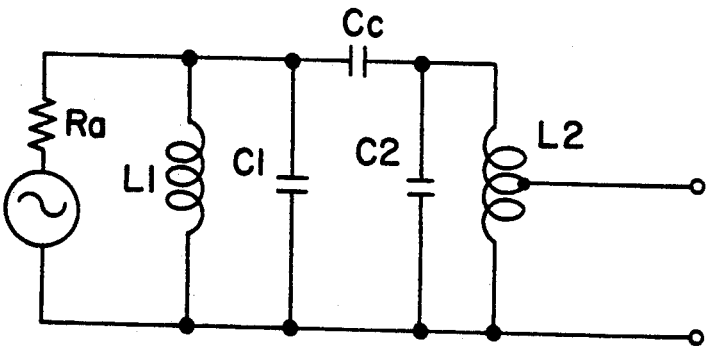

For the FM reception frequency band, as shown in FIGS. 2*a* and 3*a*, both the wire W1 and heater wire H1 act as an antenna. The wire W1 and heater wire H1 are both resonant in the FM reception frequency band and are inductively and capacitively coupled together so that a state of double resonance is created. The coupling strength of the two is more or less in a critical coupling; accordingly, the frequency band characteristics (reflection loss characteristics), when seen from the antenna output terminal (i. e., the terminal of the wire W1), show double-peak characteristics, thus broad-band characteristics are obtained. As a result, matching of the antenna and feeder F can be obtained for the entire FM reception frequency band, and thus a good FM reception is obtained without using the FM compensating amplifier 31 which is necessary in the conventional antennas. In addition, since the terminals of the heater wire H1 are grounded in terms of high-frequency via the capacitor C, the entry of noise from the power supply B into the heater wire H1 is prevented.

Figure 2B:
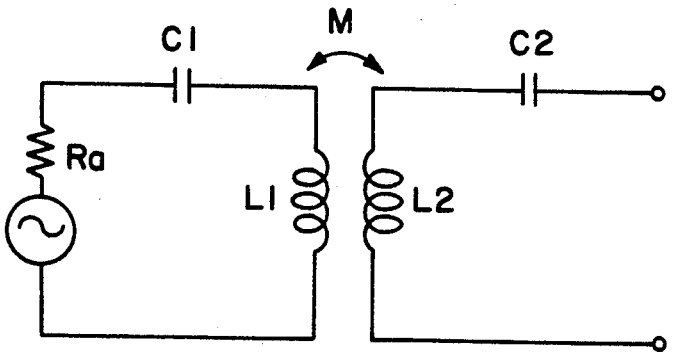

In the equivalent circuit shown in FIGS. 2*b* and 3*a*, the equivalent capacitance Cl and equivalent inductance L1 of the heater wire H1 and the radiation resistance Ra of the antenna exist as conceptional entities. The equivalent capacitance C2 and equivalent inductance L2 of the wire W1 also exist as conceptional entities.

Next, an AM reception in the above-described embodiment will be described.

Figure 4A:
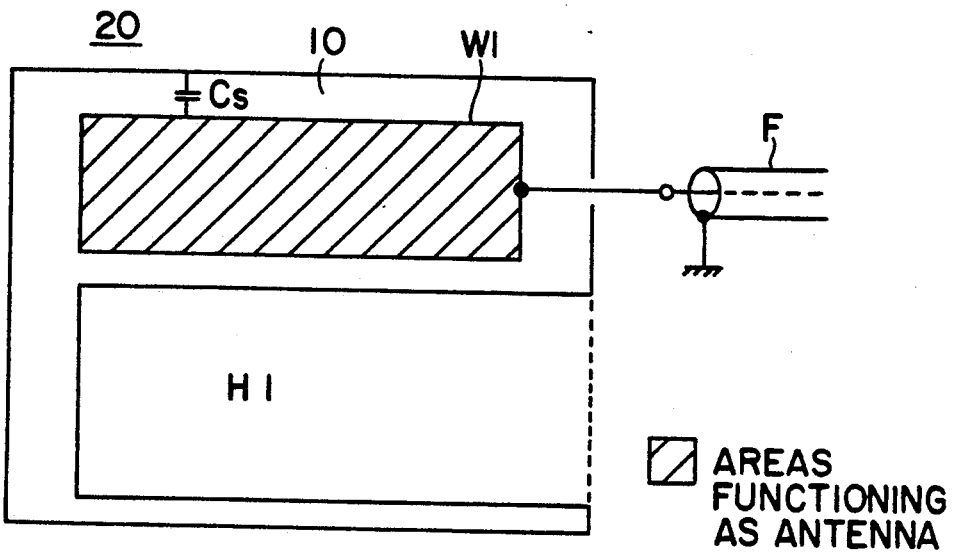
FIGS. 4*a* and 4*b* show the principle of operation for an AM reception frequency band and an equivalent circuit therfor in the embodiment above.
Figure 4B:
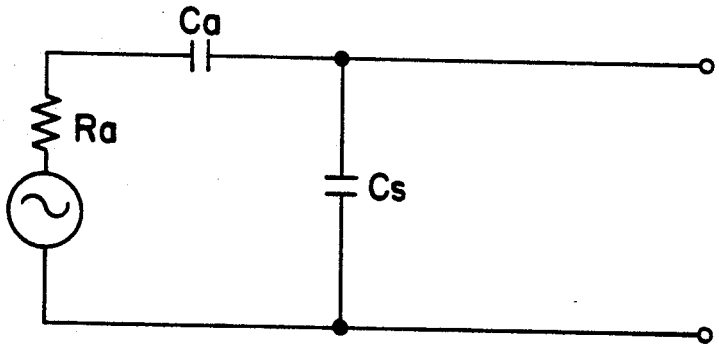

FIGS. 4*a* and 4*b* show the principle of operation and an equivalent circuit for an AM reception frequency band. For the AM reception frequency band, only the wire W1 acts as an antenna. The reason why only the wire W1 can act as an antenna is that the wire W1 and the heater wire H1 are both extremely short in length compared to the AM reception wavelength, and since one end of the heater wire H1 is grounded, the heater wire H1 is more or less equivalent to a grounding conductor; and as a result, there is absolutely no electrical coupling between the wire W1 and the heater wire H1. Because of this fact, there is no inflow of noise from the power supply B into the wire W1 during the AM reception.

In the above embodiment, since the wire W1 and the automobile body 20 (i. e., the vehicle body as a grounding plate) are sufficiently spaced, thus the antenna has a small stray capacitance. Accordingly, the capacitance splitting loss, which is caused by antenna capacitance Ca (which acts effectively as an antenna) and stray capacitance Cs (which acts ineffectively), can be minimal, and therefore, an effective AM reception is obtainable.

Figure 5:
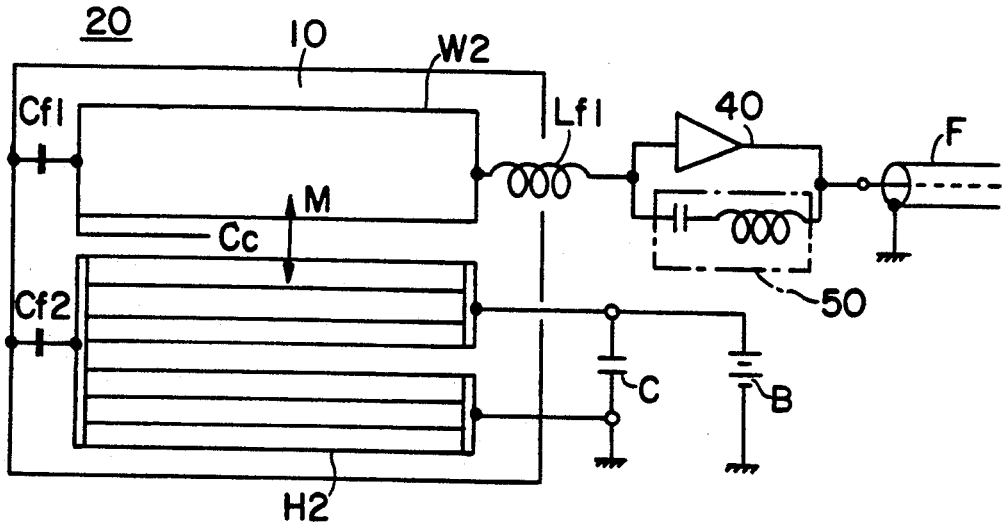
FIG. 5 illustrates another embodiment of the present invention.

FIG. 5 is a circuit diagram of another embodiment of the present invention.

In this embodiment, a compensating circuit, which consists of an AM impedance conversion circuit 40 and an FM matching-bypass circuit 50, is inserted between the feeder F and the output terminal of the wire W2. The AM impedance conversion circuit 40 converts high impedance which is for AM reception frequency into low impedance. An example of this AM impedance conversion circuit 40 is shown in FIG. 6.

Because of the AM impedance conversion circuit 40 thus installed, it is possible to greatly reduce the capacitance splitting loss in the feeder F compared to the embodiment shown in FIG. 1.

In the embodiment shown in FIG. 5, the wire W2, involving a resonance frequency adjusting capacitor Cf1 and a resonance frequency adjusting inductor Lf1, is resonant in the FM reception frequency band. However, either the resonance frequency adjusting capacitor Cf1 or the resonance frequency adjusting inductor Lf1 can be omitted; and it is also possible to shape the wire W2 such that it can solely resonate in the FM reception frequency band.

Figure 6:
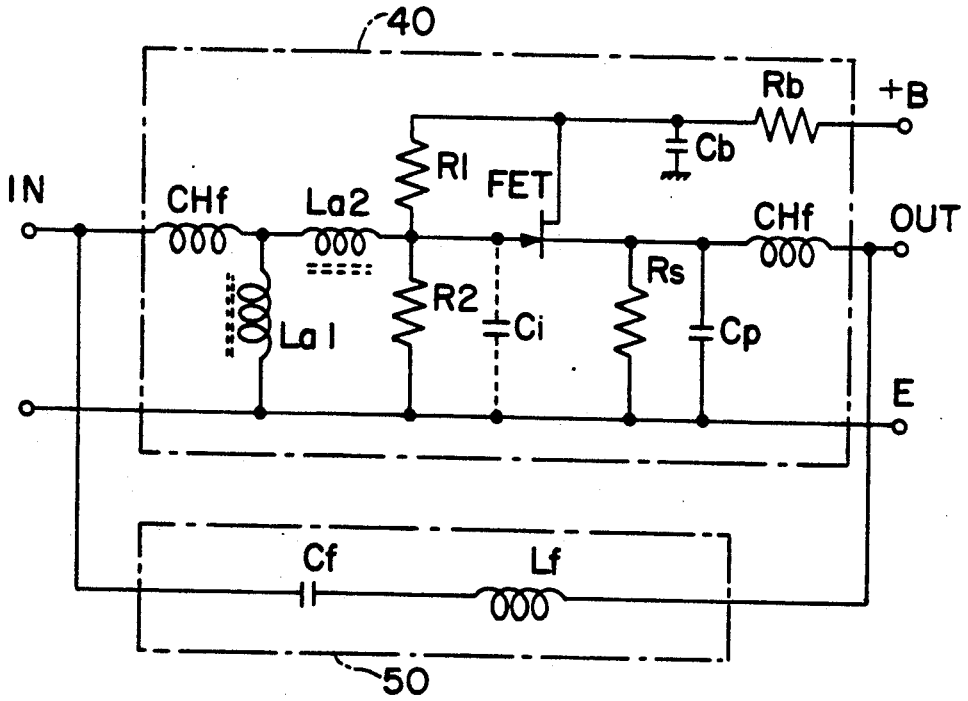
FIG. 6 is a circuit diagram of one example of the AM impedance conversion circuit used int he embodiment illustrated in FIG. 5.

Furthermore, in the embodiment shown in FIG. 6, the heater wire H2, involving a resonance frequency adjusting capacitor Cf2, is resonant in the FM reception frequency band. It is, however, possible to use a resonance frequency adjusting inductor instead of the resonance frequency adjusting capacitor Cf2; and it is also possible to shape the heater wire H2 such that the heater wire H2 can solely resonate in the FM reception frequency band. Incidentally, both the resonance frequency adjusting capacitors and resonance frequency adjusting inductors can be utilized in order to achieve a resonance in the FM reception frequency band as in the case of the embodiment illustrated in FIG. 1.

Figure 7:
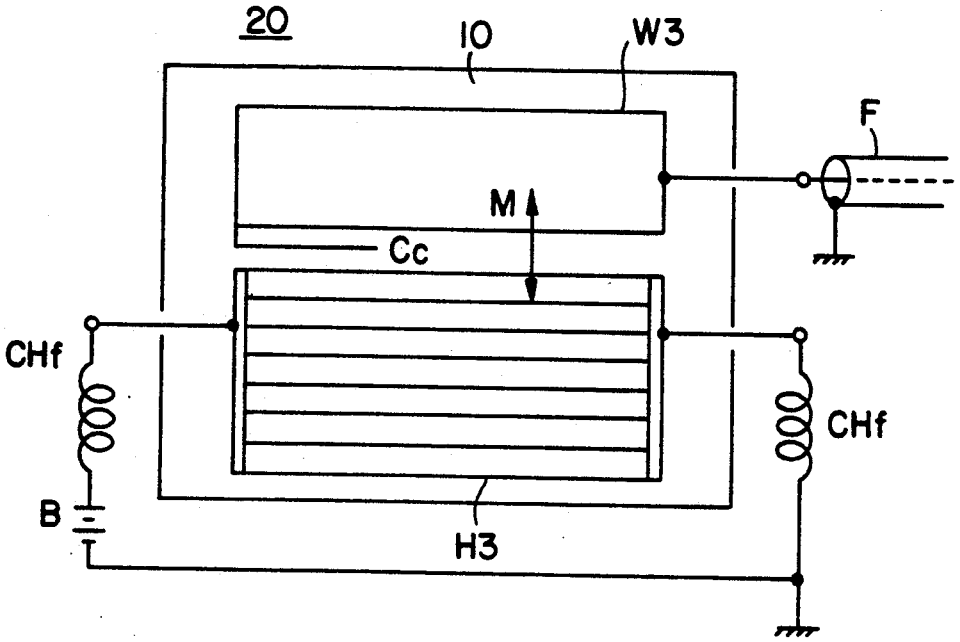
FIG. 7 illustrates still another embodiment of the present invention.
Figure 8:
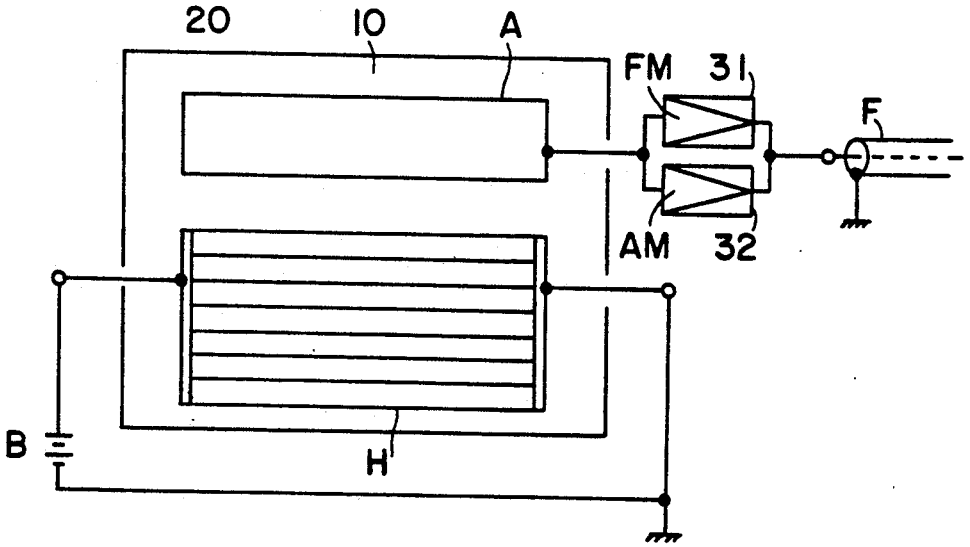
FIG. 8 is an explanatory diagram of a conventional example.
Figure 9:
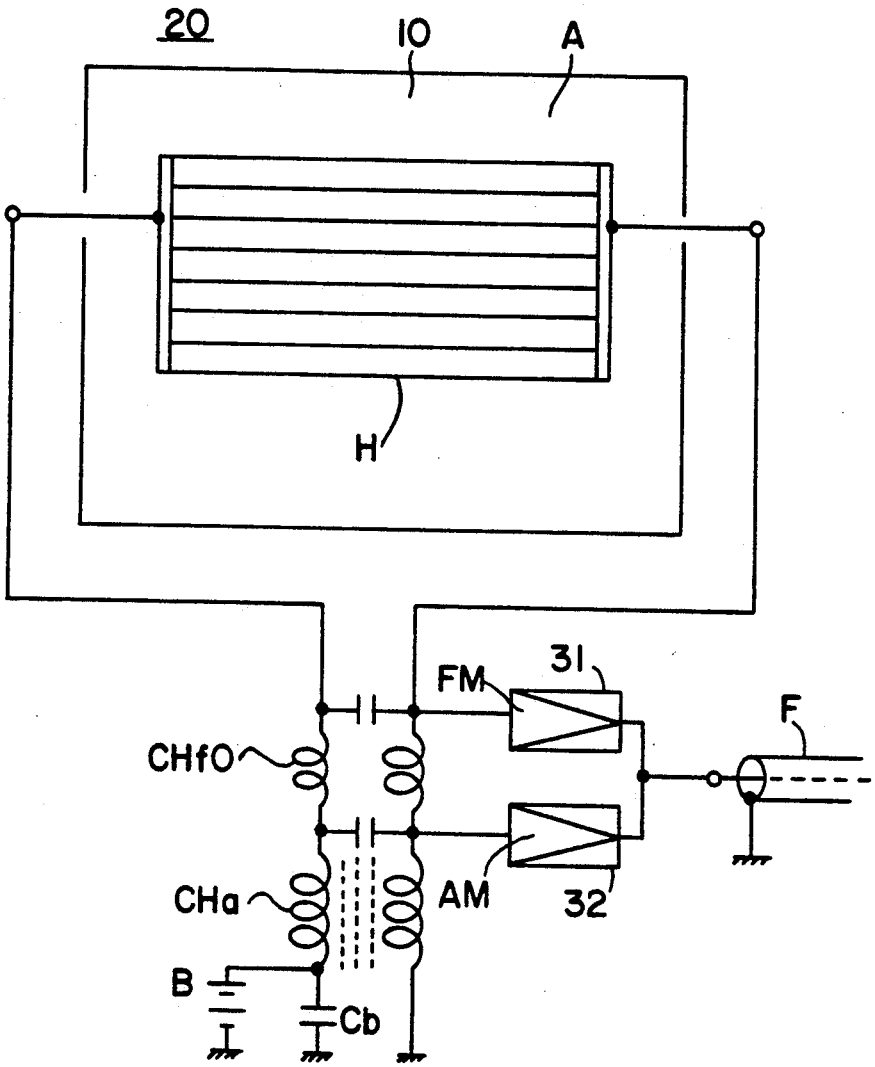
FIG. 9 is an explanatory diagram of another conventional example.

FIG. 7 illustrates still another embodiment of the present invention.

In this embodiment, the terminals of the heater wire H1 are not grounded in terms of high-frequency by the capacitor; instead, the heater wire H3 is insulated in terms of high frequency from the power supply B in the FM reception frequency band by FM choke coils CHf. In other words, the heater wire H3 is prevented from receiving high-frequency signals from the power supply B. In this embodiment of FIG. 7, the wire W3 and the heater wire H3 are inductively and capacitively coupled. Also, in this embodiment, receiving of FM reception frequency band under inductive coupling and receiving of FM and AM reception bands under capacitive coupling are the same as those described in FIGS. 2, 3 and 4.

It is also possible to use other type of conductors instead of wires W1, W2 and W3. For example, transparent conductors obtained by forming silver, tin, etc., into a thin film with a thickness of a few microns can be used instead of the wires W1, W2 and W3. In addition, though the above description is made about the reception of FM and AM frequency bands, the antenna of the present invention can be used for a first reception frequency which is not the FM reception frequency and for a second reception frequency which is not the AM reception frequency.

MERITS OF THE INVENTION

According to the present invention, since the matching for the entire FM reception frequency can be accomplished by a simple structure, the FM compensating amplifiers used in the conventional antennas are unnecessary, and the cost of the antenna is reduced. Furthermore, a generation of noise and an occurrence of cross modulation, etc. are prevented.

We claim:

1. An automobile windshield antenna for receiving a first reception frequency band and a second reception frequency band, said antenna comprising:

a defogging heater wire which resonates in said first reception frequency band but not in said second reception frequency band, a terminal of said heater wire being grounded in terms of high-frequency by a capacitor or insulated in terms of high-frequency from a power supply circuit by a choke coil for said first reception frequency band, and a conductor which is installed in said window glass and has an output terminal, said conductor being resonant in said first reception frequency band but not in said second reception frequency band, wherein said heater wire and conductor are installed in such a positional relationship that said heater wire and conductor are inductively and capacitively coupled together in said first reception frequency band, thus forming a state of double resonance, said heater wire and conductor are respectively capable of reception in said first reception frequency band, and said heater wire and conductor are electrically not coupled in said second reception frequency band so that reception of said second reception frequency band is accomplished only by said conductor.

2. An automobile windshield antenna according to claim 1, wherein said first reception frequency band encompasses FM broadcast frequencies and said second reception frequency band encompasses AM broadcast frequencies.

3. An automobile windshield antenna according to claim 1 wherein:

said heater wire has a dimension by which said heater wire resonates independently in said first reception frequency band; and said conductor has a dimension by which said conductor resonates independently in said first reception band.

4. An automobile windshield antenna according to claim 1, wherein said heater wire and said conductor are substantially critically coupled in said first reception frequency band.

5. An automobile windshield antenna according to claim 1, wherein said output terminal of said conductor is connected directly to a feeder.

6. An automobile windshield antenna according to claim 1, wherein:

said heater wire, involving a resonance frequency adjusting inductor or capacitor, resonates in said first reception frequency band; and said conductor, involving a resonance frequency adjusting inductor or capacitor, resonates in said first reception frequency band.

7. An automobile windshield antenna according to claim 1, wherein said output terminal of said conductor is connected to a feeder via a compensating circuit which includes a matching circuit for said first reception frequency band and an active impedance converter which converts high antenna impedance for said second reception frequency band into a low impedance.

* * * * *